US009071912B1

(12) United States Patent
Rosenblum et al.

(10) Patent No.: US 9,071,912 B1
(45) Date of Patent: Jun. 30, 2015

(54) AUDIO TEST TOOL

(71) Applicant: CLEAR-COM LLC, Alameda, CA (US)

(72) Inventors: Rom Rosenblum, Albany, CA (US); Nigel Gordon, Hertfordshire (GB)

(73) Assignee: CLEAR-COM LLC, Alameda, CA (US)

( * ) Notice: Subject to any disclaimer, the term of this patent is extended or adjusted under 35 U.S.C. 154(b) by 275 days.

(21) Appl. No.: 13/763,540

(22) Filed: Feb. 8, 2013

(51) Int. Cl.
*H04R 29/00* (2006.01)

(52) U.S. Cl.
CPC ..... *H04R 29/00* (2013.01)

(58) Field of Classification Search
CPC ..... H04R 29/00
USPC ..... 324/527, 542; 340/514; 370/242, 260; 379/15.01; 381/58, 59; 439/502; 700/94; 702/108; 710/17; 307/66; 320/107; 375/222
See application file for complete search history.

(56) References Cited

U.S. PATENT DOCUMENTS

| | | | | | |
|---|---|---|---|---|---|
| 4,281,283 | A * | 7/1981 | Ross et al. | 324/556 |
| 4,419,616 | A * | 12/1983 | Baskins et al. | 320/115 |
| 4,670,709 | A * | 6/1987 | Iredale | 324/542 |
| 4,912,755 | A | 3/1990 | Blood et al. | 379/6 |
| 5,025,466 | A | 6/1991 | Hilligoss et al. | 379/1 |
| 5,193,108 | A | 3/1993 | Stocklin | 379/21 |
| 5,477,152 | A * | 12/1995 | Hayhurst | 324/542 |
| 5,574,769 | A | 11/1996 | Clement | 379/21 |
| 6,138,051 | A * | 10/2000 | Dieterich | 700/94 |
| 6,201,370 | B1 * | 3/2001 | Reller et al. | 320/107 |
| 6,232,785 | B1 * | 5/2001 | Kelsey | 324/527 |
| 6,323,654 | B1 | 11/2001 | Needle et al. | 324/534 |
| 6,789,139 | B2 * | 9/2004 | Pereira | 710/17 |
| 7,026,803 | B2 | 4/2006 | Kurth | 324/66 |
| 7,039,478 | B2 * | 5/2006 | Ledoux et al. | 700/94 |
| 7,130,273 | B2 * | 10/2006 | Baj | 370/242 |
| 7,388,946 | B1 * | 6/2008 | Mussman et al. | 379/15.01 |
| 7,785,541 | B1 * | 8/2010 | Fiorello | 422/124 |
| 8,311,085 | B2 * | 11/2012 | Albiston et al. | 375/222 |
| 8,358,787 | B2 * | 1/2013 | Lee et al. | 381/58 |
| 8,469,736 | B2 * | 6/2013 | Pan et al. | 439/502 |
| 2007/0019571 | A1 * | 1/2007 | Stogel | 370/260 |
| 2008/0054723 | A1 * | 3/2008 | Noh et al. | 307/66 |
| 2011/0123034 | A1 * | 5/2011 | Lou | 381/58 |
| 2013/0076506 | A1 * | 3/2013 | Smith et al. | 340/514 |
| 2013/0083935 | A1 * | 4/2013 | Yang et al. | 381/58 |
| 2013/0103341 | A1 * | 4/2013 | Partee | 702/108 |

* cited by examiner

*Primary Examiner* — Gerald Gauthier
(74) *Attorney, Agent, or Firm* — Pillsbury Winthrop Shaw Pittman LLP

(57) ABSTRACT

This disclosure relates to a portable audio test tool configured for testing an audio circuit. The portable audio test tool may replace an assortment of non-portable and/or bulky test equipment. The portable audio test tool may comprise a small and efficient troubleshooting tool that includes the functionality of multiple pieces of test equipment in a hand-held, pocket sized form. The portable audio test tool may be powered by a rechargeable power source recharged via power from a wet intercom's DC voltage power circuit cable. In some implementations, the portable audio test tool may comprise a tool connector, a tone generator, a transducer, a voltage indicator device, a power circuit, a switching device, a housing, a user interface, and/or other components.

18 Claims, 4 Drawing Sheets

AUDIO TEST TOOL

FIELD OF THE DISCLOSURE

This disclosure relates to a portable audio test tool configured for testing an audio circuit.

BACKGROUND

Troubleshooting professional audio circuits requires an assortment of test equipment. In the field of audio/video production, those responsible for setting up and maintaining systems are often required to carry the test equipment. The assortment of test equipment may include a variety of separate testing and troubleshooting devices, such as, for example, tone generators, portable audio amplifiers, and voltage metering devices. Typically, one carries a large "listen box" and several other tools that are cumbersome to carry.

SUMMARY

One aspect of the disclosure relates to a portable audio test tool configured for testing an audio circuit. The portable audio test tool may replace an assortment of non-portable and/or bulky test equipment. The portable audio test tool may comprise a small and efficient troubleshooting tool that includes the functionality of multiple pieces of test equipment in a hand-held, pocket sized form. For example, the portable audio test tool may be configured to indicate whether a line of an audio circuit cable is powered, indicate on which pin(s) of a cable connector the power resides, generate a test tone, generate audible sound responsive to receiving an audio signal, and/or perform other functions. The portable audio test tool may be powered by a rechargeable power source recharged via power from the audio circuit cable. In some implementations, the portable audio test tool may comprise a tool connector, a tone generator, a transducer, a voltage indicator device, a power circuit, a switching device, a housing, a user interface, and/or other components. The audio circuit may include a cable. The cable may include one or more cable lines, a cable connector, and one or more cable connector pins, for example.

The tool connector may be configured to be coupled with the cable connector. The tool connector may include tool connector pins configured to be coupled with the cable connector pins. In some implementations, the cable may be a party line powered XLR cable. The tool connector may be an XLR connector such that the portable audio test tool may be coupled with the XLR cable connector. In some implementations, the tool connector may include two or more tool connectors. The tool connector may include both a male XLR connector and a female XLR connector. In some implementations, the tool connector may be configured such that the portable audio test tool may be connected as an add-on to the audio circuit. In some implementations, the tool connector may be configured such that the portable audio test tool may be connected as a pass-through device. In some implementations, the tool connector may have three pins that couple with three corresponding cable connector pins.

The tone generator may be configured to generate a test tone signal for delivery on a combination of any of the tool connector pins. The tone generator may be configured such that the test tone signal is selectable by a user to one or more of the pins of the tool connector. In some implementations, the tone generator may generate a fixed 700 Hz tone.

The transducer may be configured to generate audible sound responsive to receiving an audio signal on one or more of the tool connector pins. In some implementations, the transducer may require about 1 Watt of power to generate the audible sound. The transducer may facilitate confirmation by a user that that line level audio, for example, is being sent along a cable of the audio circuit.

The voltage indicator device may be configured to identify which individual one of the cable connector pins is a power pin. The voltage indicator device may be configured to determine an amount of power and/or voltage on one or more lines of the cable. In some implementations, the voltage indicator device may be configured to identify which cable line voltage is being sent on, whether the voltage is arriving, and on which pin. In some implementations, the voltage indicator device may be configured to communicate the identified information to the user interface for display to a user. This may inform a user of whether there is phantom voltage for a microphone and/or how many legs of power are on an intercom wet line, for example. In some implementations, the voltage indicator device may include a voltmeter.

The power circuit may be configured to supply power to the tone generator, the transducer, the voltage indicator device, the user interface, and/or other components of the portable audio test tool. In some implementations, the power circuit may include one or more printed circuit boards, wiring, a charger, a rechargeable power source, and/or other components. The rechargeable power source may be configured to be recharged via power from a given powered audio circuit cable by the charger. For example, the rechargeable power source may be recharged by coupling the portable audio test tool with any given party line powered XLR line. In some implementations, responsive to power being delivered by the cable, the rechargeable power source may be recharged while the portable audio test tool is testing the audio circuit.

The switching device may be configured to connect a powered tool connector pin to the power circuit. The powered tool connector pin may receive power from a powered cable connector pin associated with a powered line of the audio circuit cable. The switching device may be configured such that the powered tool connector pin may be any one of the pins of the tool connector.

The housing may be configured to house the tool connector, the tone generator, the transducer, the voltage indicator device, the power circuit, the switching device, the user interface, and/or other components of the portable audio test tool. The housing may be configured to contain the components of the portable audio test tool in a space small enough to be handheld and portable so that audio technicians and/or other users may easily carry and/or transport the portable audio test tool around a job site, for example.

The user interface may be configured to provide an interface between the portable audio test tool and users through which users may provide information to and receive information from portable audio test tool. This enables cues, power indications, data, results, instructions, and/or any other communicable items, collectively referred to as "information," to be communicated between the users and the portable audio test tool. For example, a user may specify one or more XLR connector pins that are to receive a test tone using the user interface. As another example, a user may select a non-intrusive party line pin 2, pin 3, and/or balanced mode of operation. The user interface may be configured to indicate whether a circuit and/or line of an audio circuit cable is "wet" (powered) or "dry" (not powered).

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
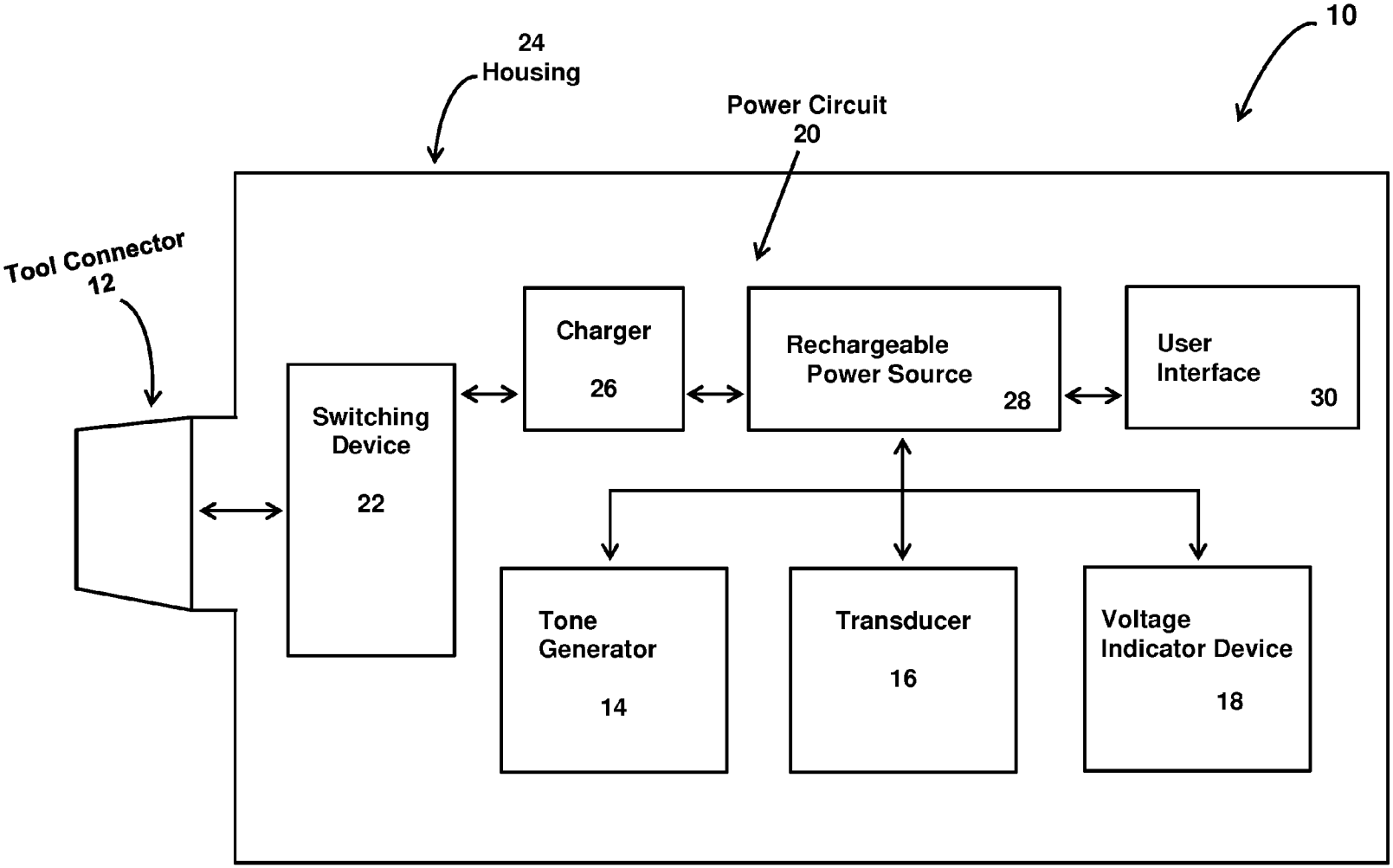
FIG. 1 illustrates a portable audio test tool configured for testing an audio circuit.

FIG. 1 illustrates a portable audio test tool 10 configured for testing an audio circuit. Portable audio test tool 10 may replace an assortment of non-portable and/or bulky test equipment. Portable audio test tool 10 may comprise a small and efficient troubleshooting tool that includes the functionality of multiple pieces of test equipment in a hand-held, pocket sized form. For example, portable audio test tool 10 may be configured to indicate whether a line of an audio circuit cable is powered, indicate on which pin(s) of a cable connector the power resides, generate a test tone, generate audible sound responsive to receiving an audio signal, and/or perform other functions. Portable audio test tool 10 may be powered by a rechargeable power source recharged via power from the audio circuit cable. In some implementations, portable audio test tool 10 may comprise a tool connector 12, a tone generator 14, a transducer 16, a voltage indicator device 18, a power circuit 20, a switching device 22, a housing 24, a user interface 30, and/or other components. The audio circuit may include a cable. The cable may include one or more cable lines, a cable connector, and one or more cable connector pins, for example.

Tool connector 12 may be configured to be coupled with the cable connector. Tool connector 12 may include tool connector pins configured to be coupled with the cable connector pins. In some implementations, the cable may be a party line powered XLR cable. Tool connector 12 may be an XLR connector such that portable audio test tool 10 may be coupled with the XLR cable connector. In some implementations, tool connector 12 may be a male XLR connector. In some implementations, tool connector 12 may be a female XLR connector. In some implementations, tool connector 12 may include two or more tool connectors. Tool connector 12 may include both a male XLR connector and a female XLR connector. In some implementations, tool connector 12 may be configured such that portable audio test tool 10 may be connected as an add-on to the audio circuit. In some implementations, tool connector 12 may be configured such that portable audio test tool 10 may be connected as a pass-through device (e.g., when a male XLR tool connector couples with a female XLR cable connector and a female XLR tool connector couples with a male XLR cable connector).

In some implementations, tool connector 12 may have three pins that couple with three corresponding cable connector pins. The three cable connector pins may be associated with lines of the audio circuit cable. The lines of the audio circuit cable may include a ground shield line, a power line (e.g., a direct current (DC) power line), an audio signal line, and/or other lines. In some implementations, the audio circuit cable may be balanced or unbalanced.

Figure 2:
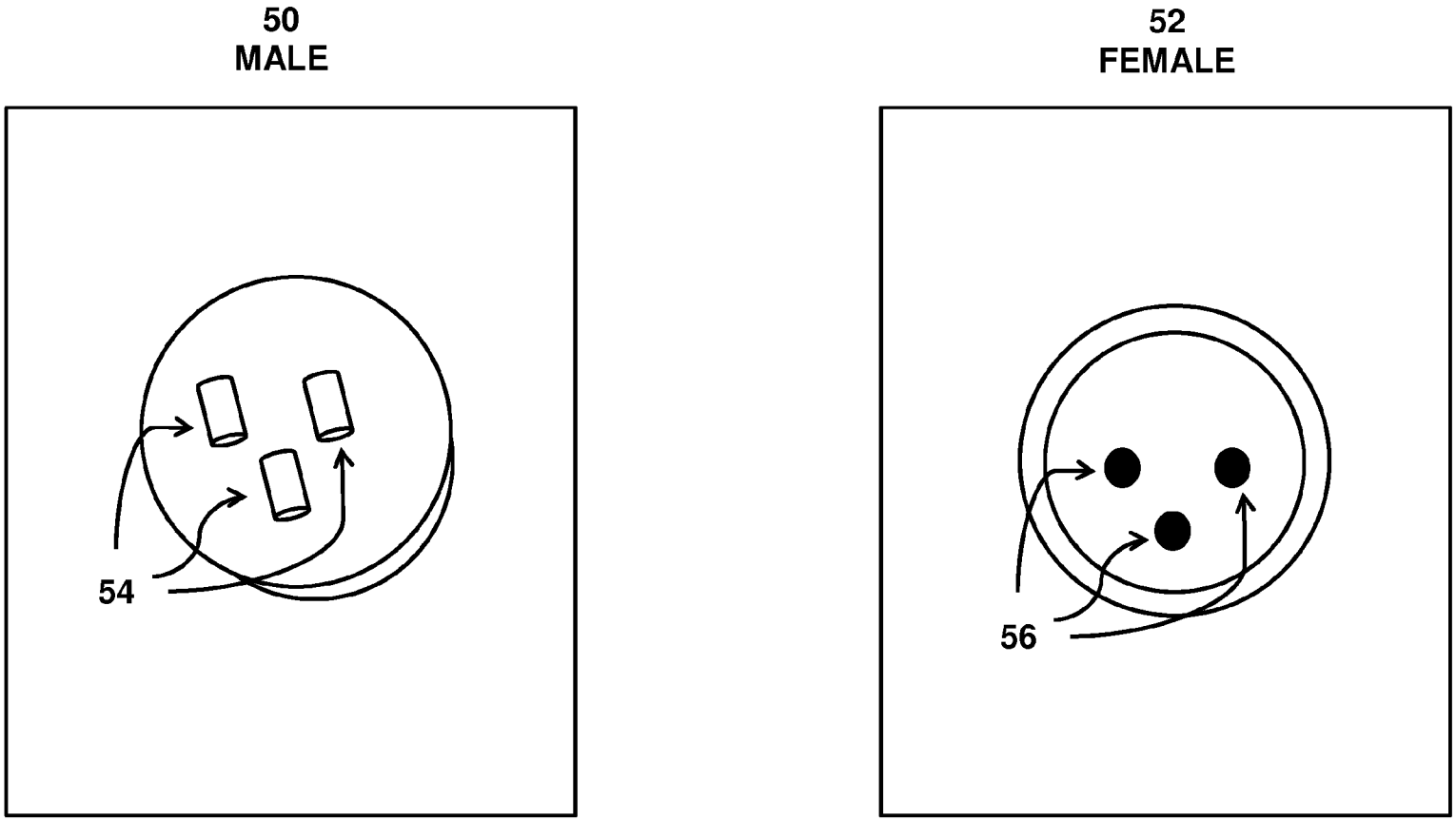
FIG. 2 illustrates examples of a male three pin connector and a female three pin connector.

By way of a non-limiting example, FIG. 2 illustrates examples of a male 50 three pin connector and a female 52 three pin connector. In some implementations, the pins 54 and/or holes 56 may be numbered "Pin 1", "Pin 2", and "Pin 3". In some implementations, for example, Pin 1 may be soldered and/or otherwise coupled with the cable shield. Pin 2 and/or Pin 3 may be soldered and/or otherwise coupled with the remaining lines of the audio circuit cable. As a second example, for 2wire, party line intercom lines, Pin 1 may be common (also shield), Pin 2 may be 30 volts DC voltage+, and Pin 3 may be 2wire audio+.

Returning to FIG. 1, tone generator 14 may be configured to generate a test tone signal for delivery on one or more of the tool connector pins. Tone generator 14 may be configured such that the test tone signal is selectable by a user (e.g., via user interface 30) to one or more of the pins of the tool connector. For example, tone generator 14 may be configured such that the test tone signal is selectable to Pins 2 and 3, and/or Pins 1 and 3. In some implementations, tone generator 14 may generate a fixed 700 Hz tone. The fixed 700 Hz tone may audibly differentiate the tone generated by tone generator 14 compared to a 1 kHz test tone (e.g., a calling tone), tones generated from other sources such as audio desks, and/or other common tone generators' test tones, for example. In some implementations, the 700 Hz tone may be adjusted to another frequency. In some implementations, a user may cause tone generator 14 to generate a given test tone signal such that the user may identify and/or check the integrity of XLR cable lines, for example. Party line powered XLR cables may be configured to carry power and test tone signals at the same time. In some implementations, tone generator 14 may be nominally −18 dBu when in party line mode and 0 dBu when in balanced mode. In some implementations, there may be a switch to engage or disengage tone generator 14. In some implementations, there may be a switch to change from line level ton to mic level tone (≈−70 dB). In some implementations, the switch may be both latchable and momentary. In some implementations, portable audio test tool 10 may include an onboard microphone as well as tone generator 14 for audio signal generation.

Transducer 16 may be configured to generate audible sound responsive to receiving an audio signal on one or more of the tool connector pins. Transducer 16 may be a speaker, for example. In some implementations, the transducer speaker may have a 3.5 mm, for example, jack for earpiece connection. Transducer 16 may be associated with an amplifier. In some implementations, transducer 16 may require about 1 Watt of power to generate the audible sound. Transducer 16 may facilitate confirmation by a user that that line level audio, for example, is being sent along a cable of the audio circuit. The user may hear audible sound responsive to transducer 16 receiving an audio signal and know that the tested cable is functioning. In some implementations, there may be a switch to engage or disengage transducer 16. The switch may be both latchable and momentary. Transducer 16 may generate the acoustic analog of the audio circuit "sound" responsive to the switch engaging transducer 16. In some implementations, the audible sound generated by transducer 16 may compliment visual information presented to the user by user interface 30. For example, transducer 16 may generate audible sound responsive to receiving an audio signal on a given tool connector pin. Voltage indicator light emitting diodes (LED) of user interface 30 may indicate visually which pin of the tool connector is receiving the audio signal.

Voltage indicator device 18 may be configured to identify which individual one of the cable connector pins is a power pin. Voltage indicator device 18 may be configured to determine an amount of power and/or voltage on one or more lines of the cable. In some implementations, voltage indicator device 18 may be configured to identify which cable line voltage is being sent on, whether the voltage is arriving, and on which pin. In some implementations, voltage indicator device 18 may be configured to communicate the identified information to user interface 30 for display to a user. This may inform a user of whether there is phantom voltage for a microphone and/or how many legs of power are on an intercom wet line, for example. In some implementations, voltage indicator device 18 may include a voltmeter.

Power circuit 20 may be configured to supply power to tone generator 14, transducer 16, voltage indicator device 18, user interface 30, and/or other components of portable audio test tool 10. In some implementations, power circuit 20 may include one or more printed circuit boards, wiring, a charger 26, a rechargeable power source 28, and/or other components. Rechargeable power source 28 may be configured to be recharged via power from a powered cable (e.g., a wet intercom's DC voltage power circuit cable) by charger 26. For example, rechargeable power source 28 may be recharged by coupling portable audio test tool 10 with any given party line powered XLR line.

In some implementations, responsive to power being delivered by the cable, rechargeable power source 28 may be recharged while portable audio test tool 10 is testing the audio circuit. The testing may include one or more of generating the test tone signal, generating the audible sound, identifying which individual one of the cable connector pins is a power pin, and/or other testing.

Rechargeable power source 28 may be configured to power tone generator 14, transducer 16, voltage indicator device 18; user interface 30, and/or other components of portable audio test tool 10 in a portable manner. Rechargeable power source 28 may comprise one or more power sources connected in series and/or in parallel. Rechargeable power source 28 may be recharged via power found in intercom power across Pin 2 (Pin 1 common) and may accept all standard intercom 24 to 30 volt industry standard power schemes, for example. In some implementations, rechargeable power source 28 may be a lithium ion battery. In some implementations, rechargeable power source 28 may be configured to power portable audio test tool 10 for 12 or more hours of use. In some implementations, rechargeable power source 28 may be configured to power portable audio test tool 10 for up to 12 hours of use. In some implementations, rechargeable power source 28 may be configured to power portable audio test tool 10 for up to 8 hours of use. In some implementations, rechargeable power source 28 may be configured to power portable audio test tool 10 for up to 6 hours of use. Charger 26 may be configured to charge rechargeable power source 28. In some implementations, charger 26 may be configured to charge rechargeable power source 28 responsive to the audio circuit cable being powered.

Switching device 22 may be configured to connect a powered tool connector pin to power circuit 20. The powered tool connector pin may receive power from a powered cable connector pin associated with a powered line of the audio circuit cable. Switching device 22 may be configured such that the powered tool connector pin may be any one of the pins of tool connector 12. Switching device 22 may include, for example, a bus, a digital switch, and/or other switching devices.

Housing 24 may be configured to house tool connector 12, tone generator 14, transducer 16, voltage indicator device 18, power circuit 20, switching device 22, user interface 30, and/or other components of portable audio test tool 10. Housing 24 may be configured to contain the components of portable audio test tool 10 in a space small enough to be handheld and portable so that audio technicians and/or other users may easily carry and/or transport portable audio test tool 10 around a job site, for example. In some implementations, the weight of portable audio test tool 10 may be up to about 250 g. In some implementations, the weight of portable audio test tool 10 may be up to about 150 g. In some implementations, the weight of portable audio test tool 10 may be about 120 g. In some implementations, the volume of housing 24 may be up to about 500,000 cubic millimeters. In some implementations, the volume of housing 24 may be up to about 100,000 cubic millimeters. In some implementations, the volume of housing 24 may be up to about 10,000 cubic millimeters.

Figure 3:
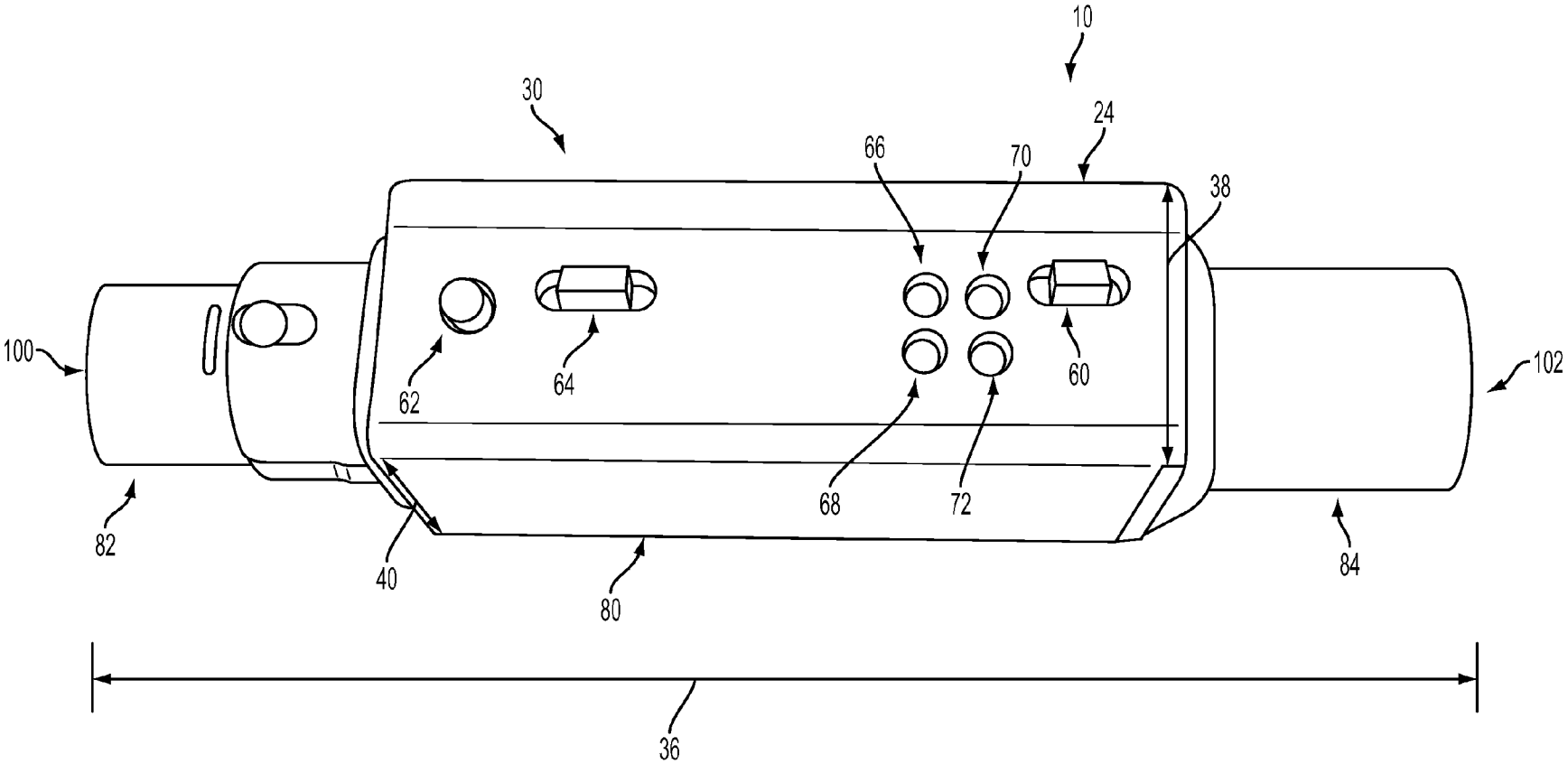
FIG. 3 shows a perspective view of an example implementation of the portable audio test tool.

By way of a non-limiting example, FIG. 3 shows a perspective view of an example implementation of portable audio test tool 10. In the example shown in FIG. 3, portable audio test tool has a central body 80, a first end section 82 at first end 100, and a second end section 84 at second end 102. Central body 80 has a generally rectangular cross section. First end section 82 and second end section 84 have generally circular cross sections. In some implementations, central body 80 may house tone generator 14 (shown in FIG. 1), transducer 16 (shown in FIG. 1), voltage indicator device 18 (shown in FIG. 1), power circuit 20 (shown in FIG. 1), switching device 22 (shown in FIG. 1), and/or other components of portable audio test tool 10. User interface 30 may be formed in a surface of central body 80. Male and/or female tool connectors (e.g., tool connector 12 shown in FIG. 1) may be formed in first end section 82 and/or second end section 84.

In some implementations, housing 24 may have an overall length 36 of less than about 200 mm. Length 36 may be between about 100 mm and about 200 mm. Length 36 may be about 124 mm. In some implementations, central body 80 may have a depth 38 of less than about 50 mm. Depth 38 may be between about 20 mm and about 50 mm. Depth 38 may be about 31 mm. In some implementations, central body 80 may have a height 40 of less than about 50 mm. Height 40 may be between about 20 mm and about 50 mm. Height 40 may be about 26 mm. The general form factor and approximate dimensions of housing 24 shown in FIG. 3 are not intended to be limiting. Housing 24 may take any shape that allows it to function as described in the present disclosure.

In some implementations, a handle may be attached to and/or formed by housing 24. The handle may be configured to be grasped by a user to hold portable audio test tool 10 during use. The handle may be attached to housing 24 by coupling the handle to housing 24 at one or more locations with screws and/or another method of fixing the handle to housing 24. The handle may be formed in housing 24 by way of a knurled and/or other textured surface, for example. The method for mounting, and/or the form factor for the handle formed by and/or attached to housing 24 described in the present disclosure are not intended to be limiting. A handle may be attached to and/or formed in housing 24 by any method, in any shape, and/or in any location(s) that allows it to function as described herein. In some implementations, housing 24 may not include a handle.

In some implementations, housing 24 may be formed from one or more materials. In some implementations, the one or more materials may be selected based on intended use in applications such as clean rooms, controlled clean areas, chemical environments, hot environments, cold environments, wet environments, outdoor use, indoor use, and/or based on other intended uses. For example, housing 24 may be formed from anodized extruded aluminum to reduce and/or prevent corrosion.

User interface 30 may be configured to provide an interface between portable audio test tool 10 and users through which users may provide information to and receive information from portable audio test tool 10. This enables cues, power indications, data, results, instructions, and/or any other communicable items, collectively referred to as "information," to be communicated between the users and portable audio test tool 10. For example, a user may specify one or more XLR connector pins that are to receive a test tone using user interface 30. As another example, a user may select a non-intrusive party line pin 2, pin 3, and/or balanced mode of operation. User interface 30 may be configured to indicate whether a circuit and/or line of an audio circuit cable is "wet" (powered) or "dry" (not powered).

Examples of interface devices suitable for inclusion in user interface 30 comprise light emitting diodes, a keypad, buttons, switches, a keyboard, knobs, levers, a display screen, a touch screen, indicators, an audible alarm, a printer, and/or other interface devices. In some implementations, user interface 30 may comprise a plurality of separate interfaces (e.g., lights, a button, a switch). In some implementations, user interface 30 may comprise at least one interface that is provided integrally with housing 24.

As shown in FIG. 3, user interface 30 may include an on/off power switch 60, a tone generation button 62, an audio circuit type (e.g., unbalanced Pin 2, unbalanced Pin 3, balanced) selector 64, an LED indicator 66 that indicates whether portable audio test tool 10 power is "on", an LED indicator 68 that indicates whether portable audio test tool 10 is charging, and LED indicators 70, 72 configured to indicate whether Pin 2 and/or Pin 3 are "wet" (e.g., voltage detection on XLR Pin 2 and/or Pin 3). In some implementations, user interface 30 may comprise a button to enable the transducer to generate audible sound.

It is to be understood that other communication techniques, either hard-wired or wireless, are also contemplated by the present disclosure as user interface 30. For example, the present disclosure contemplates that user interface 30 may be integrated with a removable electronic storage interface. In this example, information may be loaded into portable audio test tool 10 from removable storage (e.g., a smart card, a flash drive, a removable disk, etc.) that enables users to customize the implementation of portable audio test tool 10. Other exemplary input devices and techniques adapted for use with portable audio test tool 10 as user interface 30 comprise, but are not limited to, an RS-232 port, RF link, an IR link, a modem (telephone, cable or other), and/or other input devices and/or techniques. In short, any technique for communicating information with portable audio test tool 10 is contemplated by the present disclosure as user interface 30.

Figure 4:
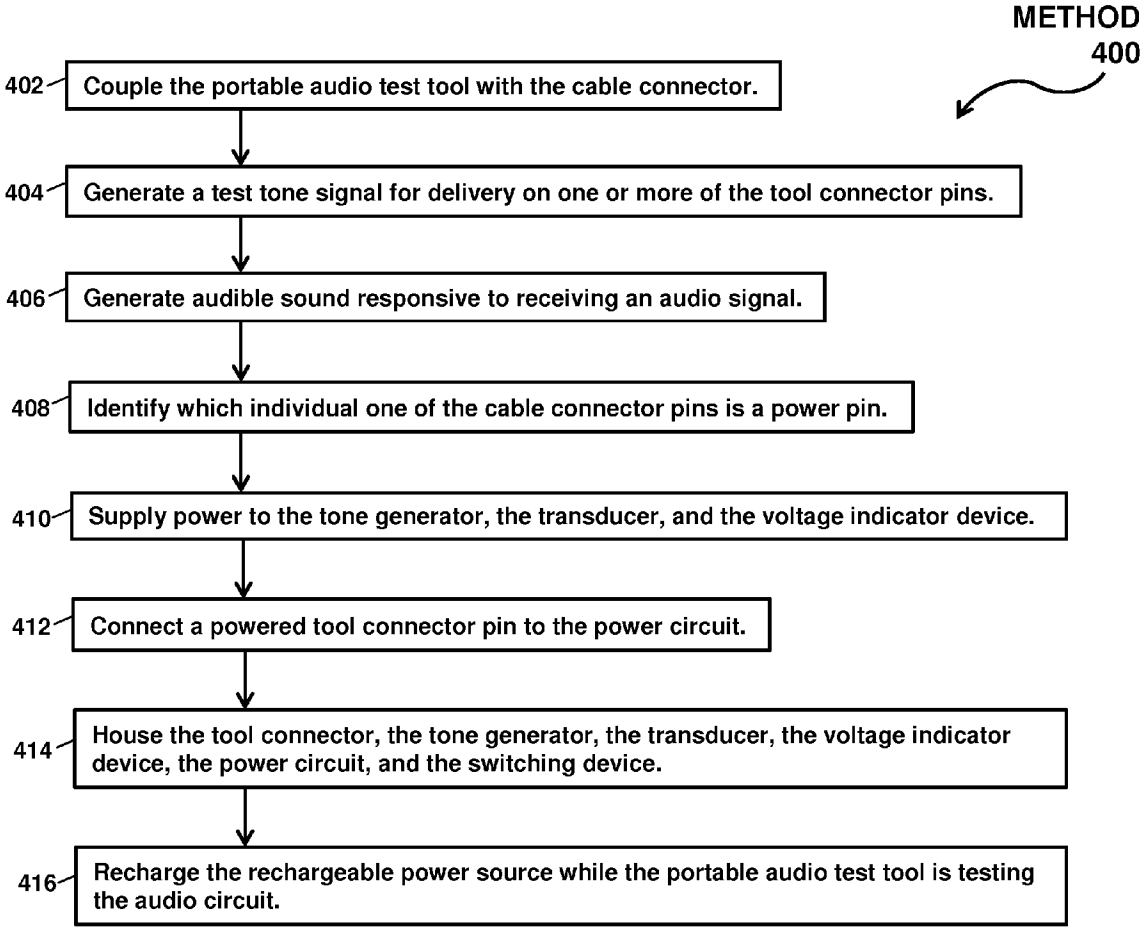
FIG. 4 illustrates a method for testing an audio circuit with a portable audio test tool.

FIG. 4 illustrates a method 400 for testing an audio circuit with a portable audio test tool. The audio circuit may include a cable. The cable may include one or more cable lines, a cable connector, and one or more cable connector pins. The operations of method 400 presented below are intended to be illustrative. In some implementations, method 400 may be accomplished with one or more additional operations not described, and/or without one or more of the operations discussed. Additionally, the order in which the operations of method 400 are illustrated in FIG. 4 and described herein is not intended to be limiting.

In some implementations, method 400 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 400 in response to instructions stored electronically on one or more electronic storage mediums. The one or more processing devices may include one or more devices configured through hardware, firmware, and/or software to be specifically designed for execution of one or more of the operations of method 400.

At an operation 402, the portable audio test tool may be coupled with the cable connector. The coupling may be performed by a tool connector of the portable audio test tool. The tool connector may include tool connector pins configured to be coupled with the cable connector pins. In some implementations, operation 402 may be performed by a tool connector the same as or similar to tool connector 12 (shown in FIG. 1 and described herein).

At an operation 404, a test tone signal for delivery on one or more of the tool connector pins may be generated. In some implementations, operation 404 may be performed by a tone generator the same as or similar to tone generator 14 (shown in FIG. 1 and described herein).

At an operation 406, audible sound may be generated responsive to the portable audio test tool receiving an audio signal. The audible sound may be generated with a transducer of the portable audio test tool. The audible sound may be generated responsive to receiving an audio signal on one or more of the tool connector pins. In some implementations, operation 406 may be performed by a transducer the same as or similar to transducer 16 (shown in FIG. 1 and described herein).

At an operation 408, the individual one of the cable connector pins that is a power pin may be identified. Identifying which individual one of the cable connector pins is a power pin may be accomplished with a voltage indicator device of the portable audio test tool. In some implementations, operation 408 may be performed by a voltage indicator device the same as or similar to voltage indicator device 18 (shown in FIG. 1 and described herein).

At an operation 410, power may be supplied to the tone generator, the transducer, the voltage indicator device, and/or other components of the portable audio test tool. Power may be supplied with a power circuit of the portable audio test tool. The power circuit may include a charger and a rechargeable power source configured to be recharged via the charger. In some implementations, operation 410 may be performed by a power circuit the same as or similar to power circuit 20 (shown in FIG. 1 and described herein).

At an operation 412, a powered tool connector pin may be connected to the power circuit. In some implementations, operation 412 may be performed by a switching device the same as or similar to switching device 22 (shown in FIG. 1 and described herein).

At an operation 414, the tool connector, the tone generator, the transducer, the voltage indicator device, the power circuit, the switching device, and/or other components of the portable audio test tool may be housed with a housing of the portable audio test tool. In some implementations, operation 414 may be performed by a housing the same as or similar to housing 24 (shown in FIG. 1 and described herein).

At an operation 416, the rechargeable power source may be recharged while the portable audio test tool is testing the audio circuit. The rechargeable power source may be recharged responsive to power being delivered by the cable. The testing may comprise generating the test tone signal, generating the audible sound, identify which individual one of the cable connector pins is a power pin, and/or other testing. In some implementations, operation 416 may be performed by a charger the same as or similar to charger 26 (shown in FIG. 1 and described herein).

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A portable audio test tool configured for testing an audio circuit, the audio circuit including a cable, the cable comprising one or more cable lines, a cable connector, and one or more cable connector pins, wherein the portable audio test tool comprises:

a tool connector configured to be coupled with the cable connector, the tool connector including tool connector pins configured to be coupled with the cable connector pins;

a tone generator configured to generate a test tone signal for delivery on one or more of the tool connector pins;

a transducer configured to generate audible sound in response to the portable audio test tool receiving an audio signal on one or more of the tool connector pins;

a voltage indicator device configured to identify which individual one of the cable connector pins is a power pin;

a power circuit configured to supply power to the tone generator, the transducer, and the voltage indicator device, wherein the power circuit includes a charger and a rechargeable power source configured to be recharged via the charger, and wherein, in response to power being delivered through a power pin, the rechargeable power source is recharged via the power pin during testing of the audio circuit;

a switching device configured to connect a powered tool connector pin to the charger included in the power circuit; and a housing that houses the tool connector, the tone generator, the transducer, the voltage indicator device, the power circuit, and the switching device.

2. The tool of claim 1, wherein the testing includes one or more of generating the test tone signal, generating the audible sound, or identifying which individual one of the cable connector pins is a power pin.

3. The tool of claim 1, wherein the cable is a party line powered XLR cable.

4. The tool of claim 1, wherein the tool connector is an XLR connector such that the portable audio test tool is configured to be coupled with an XLR cable connector.

5. The tool of claim 1, wherein the tool connector is a male XLR connector or a female XLR connector.

6. The tool of claim 1, wherein the tool connector has three pins.

7. The tool of claim 1, wherein the tone generator is configured such that the test tone signal is selectable by a user to one or more of the pins of the tool connector.

8. The tool of claim 1, wherein the voltage indicator device includes a voltmeter.

9. The tool of claim 1, wherein the tone generator generates a 700 Hz tone.

10. The tool of claim 1, wherein a volume of the housing is up to about 10,000 cubic millimeters.

11. The tool of claim 1, wherein a weight of the portable audio test tool is about 120 g.

12. The tool of claim 1, wherein the transducer requires about 1 Watt of power to generate the audible sound.

13. The tool of claim 1, further comprising a user interface configured to receive selection from a user of a type of audio circuit, the type of audio circuit comprising a balanced audio circuit, or an unbalanced audio circuit.

14. A method for testing an audio circuit with a portable audio test tool, the audio circuit including a cable, the cable comprising one or more cable lines, a cable connector, and one or more cable connector pins, the method comprising:

coupling the portable audio test tool with the cable connector, the coupling performed by a tool connector of the portable audio test tool, the tool connector including tool connector pins configured to be coupled with the cable connector pins;

generating a test tone signal for delivery on one or more of the tool connector pins with a tone generator of the portable audio test tool;

generating, with a transducer of the portable audio test tool, audible sound in response to the portable audio test tool receiving an audio signal on one or more of the tool connector pins;

identifying which individual one of the cable connector pins is a power pin with a voltage indicator device of the portable audio test tool;

supplying power to the tone generator, the transducer, and the voltage indicator device with a power circuit of the portable audio test tool, wherein the power circuit includes a charger and a rechargeable power source;

recharging, in response to power being delivered through a power pin, the rechargeable power source via the power pin during testing of the audio circuit;

connecting, with a switching device of the portable audio test tool, a powered tool connector pin to the charger included in the power circuit; and housing the tool connector, the tone generator, the transducer, the voltage indicator device, the power circuit, and the switching device with a housing of the portable audio test tool.

15. The method of claim 14, wherein the testing includes one or more of generating the test tone signal, generating the audible sound, or identifying which individual one of the cable connector pins is a power pin.

16. The method of claim 14, wherein the tone generator generates a 700 Hz tone.

17. The method of claim 14, wherein a volume of the housing is up to about 10,000 cubic millimeters.

18. The method of claim 14, wherein a weight of the portable audio test tool is about 120 g.

* * * * *